US006966757B2

(12) United States Patent
Hardy et al.

(10) Patent No.: US 6,966,757 B2
(45) Date of Patent: Nov. 22, 2005

(54) SCRAPER BLADE ATTACHMENT APPARATUS AND METHOD WITH SPLIT PIN

(75) Inventors: Benjamin Hardy, Elkorn, WI (US); Drew Van Norman, Whitewater, WI (US)

(73) Assignee: SPX Corporation, Charlotte, NC (US)

( * ) Notice: Subject to any disclaimer, the term of this patent is extended or adjusted under 35 U.S.C. 154(b) by 104 days.

(21) Appl. No.: 10/737,794

(22) Filed: Dec. 18, 2003

(65) Prior Publication Data

US 2005/0135937 A1 Jun. 23, 2005

(51) Int. Cl.[7] ..... F01D 5/30

(52) U.S. Cl. ..... 416/204 R; 416/244 R; 415/130; 415/141; 415/178

(58) Field of Search ..... 415/175–178, 415/180, 129, 130, 140, 141; 416/135, 136, 416/205, 206–207, 219 R, 219 A, 220 R, 416/220 A, 244 R, 248, 204 R, 142; 24/498, 24/459; 165/94

(56) References Cited

U.S. PATENT DOCUMENTS

| | | | | |
|---|---|---|---|---|
| 3,235,002 | A * | 2/1966 | Bachmann et al. | 165/94 |
| 3,249,351 | A | 5/1966 | Smith | 24/498 |
| 3,385,354 | A * | 5/1968 | Bevarly | 165/94 |
| 3,848,289 | A * | 11/1974 | Bachmann | 15/246.5 |
| 4,073,339 | A * | 2/1978 | D'Orsay | 165/94 |
| 4,185,352 | A * | 1/1980 | Smith | 165/95 |
| 6,860,713 | B2 | 3/2005 | Hoover | 415/66 |
| 2004/0099405 | A1 * | 5/2004 | Hardy | 165/94 |

* cited by examiner

*Primary Examiner*—Edward K. Look
*Assistant Examiner*—Richard A. Edgar
(74) *Attorney, Agent, or Firm*—Baker & Hostetler LLP

(57) ABSTRACT

An attachment apparatus and method for interlocking attachment of a scraper blade with a drive shaft of a scraped surface heat exchanger includes a blade having dual attachment beams and a central locking member, and at least one pin having dual fingers each for interlocking with a respective attachment beam.

18 Claims, 4 Drawing Sheets

SCRAPER BLADE ATTACHMENT APPARATUS AND METHOD WITH SPLIT PIN

FIELD OF THE INVENTION

The invention pertains to the field of process equipment. More particularly, the invention pertains to the attachment of blades to a rotating drive shaft, such as for example in scraped surface heat exchangers.

BACKGROUND OF THE INVENTION

Scraped surface heat exchangers are a type of mixing apparatus well known in industry. Scraped surface heat exchangers generally feature an outer cylindrical housing tube and a central rotatable drive shaft disposed in the center of the outer housing tube. An annular space is provided between the central drive shaft and the outer housing tube, and material is forced from one end of the scraped surface heat exchanger through the annular space between the tubes.

In general, the material enters the space between the tubes near one end of the scraped surface heat exchanger and travels longitudinally along the scraped surface heat exchanger and exits near the other end of the scraped surface heat exchanger. During this time, the material can be mixed by blades which are attached to, and extend outward from, the central shaft and are rotated by the central shaft. The material may also be subject to temperature gradients as it travels along the scraped surface heat exchanger so that the material is heated or cooled.

The blades are sometimes very generally flat blades which are mounted in a pivotable fashion proximate to the surface of the central drive shaft. The blades extend outward at a relatively narrow angle from the central drive shaft and generally have a tip feature at their distal end which is in sliding contact with the inner surface of the outer housing cylinder as the blades are rotated.

The blades are generally elongated, and typically several blades are provided along the length of the scraped surface heat exchanger to occupy the length of the inner volume of the scraped surface heat exchanger. The blades serve at least some of several functions. For example, the blades can enhance overall mixing of the material as it passes along the inner volume of the scraped surface heat exchanger. The blades also can contact the inner housing of the scraped surface exchanger to in effect scrape material off the inner surface so that it does not build up on the inner surface of the housing cylinder. Further, the blades can add to general flow patterns within the heat exchanger which facilitate temperature transfer from the outer housing of the heat exchanger to the material itself. The outer housing may have a fluid jacket or other heating or cooling source to impart a desired temperature to the outer housing, so that the material can be heated or cooled as it travels through the device.

It has been known to mount the blades to the central driving shaft using so-called "pins". The pins are individual items that are attached, usually by welding, to the drive shaft surface and have some sort of receptacle area to accept a part of the blade so the blade is pivotally positioned. Two or more pins are usually used on the length of a single blade to pivotally support one blade at the locations of the pins. Previously, the blades have had a cutaway portion forming a hinge shaft or single "attachment beam" that is received in the receptacle slot of the pin to form a hinge configuration.

As noted above, the pins are typically spaced apart longitudinally along the length of the drive shaft, with two or more pins being used for each blade. For simplicity and manufacturing costs reasons, for a given length of heat exchanger it is typically desirable to reduce the number of blades and even further to reduce the number of pins. Thus, it is desirable typically to use relatively longer blades if possible, and it would be desirable to reduce the number of pins for each blade as well.

However, there can be some drawbacks to using longer blades and fewer pins when using the aforementioned prior art pin connection methods. In the prior art, the blades have tended to have relatively short attachment beams due to shear and buckling failure modes. Due to the possibility of flexing of the entire blade between the attachment points, there is a need to place the beams and pins at certain regularly defined intervals.

Another disadvantage with at least some conventional pin and beam attachment systems has been that during assembly of the device, the blade may fall out of its pin receptacle depending on the manufacturing angle of the shaft, pin, and blade.

Accordingly, there is a need in the art for a blade attachment apparatus and method that can overcome the above advantages in some instances, at least to some extent, for example by providing desirable support to the blade as well as by providing some degree of locking of the blade to prevent it from falling out during installation, while permitting some pivoting during assembly and operation.

SUMMARY OF THE INVENTION

The foregoing needs are met, to a great extent, by the present invention, wherein in one aspect an apparatus is provided that in some embodiments provides pivotal attachment of a blade to a drive shaft of a device such as a scraped surface heat exchanger.

In accordance with one embodiment of the present invention, a pin for attaching a blade to a drive shaft of a scraped surface heat exchanger, comprises a base portion, and two generally hook-shaped arm portions extending from the base portion and separated by a gap therebetween.

In accordance with another embodiment of the present invention, a blade for use with a scraped surface heat exchanger having a drive shaft, comprises at least one attachment region including a pair of cutouts each having a respective attachment beam extending across the respective cutout portion.

In accordance with yet another embodiment of the present invention, a blade attaching system for use with a scraped surface heat exchanger having a drive shaft, comprises a blade having at least one attachment region including a pair of cutouts each having a respective attachment beam extending across the respective cutout portion, and a pin having a base and two generally hook shaped arms extending from the base and generated by a gap there between, when each hooked shape arm is adapted to receive and hold a respective attachment beam of the blade.

In accordance with yet another embodiment of the present invention, a pin for attaching a blade to a drive shaft of a scraped surface heat exchanger, comprises means for mounting the pin to the drive shaft, and means for retaining the blade, comprising two generally hook-shaped arm portions extending from the mounting means and separated by a gap therebetween.

In accordance with yet another embodiment of the present invention, a blade for use with a scraped surface heat exchanger having a drive shaft with at least one pin, comprises a body portion, and at least one means for attaching the blade to the pin, including a pair of cutouts each having a respective attachment beam extending across the respective cutout portion.

In accordance with yet another embodiment of the present invention, a blade attaching system for use with a scraped surface heat exchanger, comprises blade retaining means mounted to the drive shaft having a base and two generally hook shaped arms extending from the base and generated by a gap there between, when each hooked shape arm is adapted to receive and hold a respective attachment beam of the blade, and means for attaching the blade to the pin including a pair of cutouts each having a respective attachment beam extending across the respective cutout portion.

In accordance with yet another embodiment of the present invention, a blade attaching method for use with a scraped surface heat exchanger having a drive shaft, comprises providing a blade having at least one attachment region including a pair of cutouts each having a respective attachment beam extending across the respective cutout portion, and inserting the blade into a pin having a base and two generally hook shaped arms extending from the base and generated by a gap there between, when each hooked shape arm is adapted to receive and hold a respective attachment beam of the blade.

In accordance with yet another embodiment of the present invention, a blade attaching method for use with a scraped surface heat exchanger having a drive shaft, comprises providing a blade having at least one attachment region including a pair of cutouts each having a respective attachment beam extending across the respective cutout portion, and inserting the blade into a pin having a base and two generally hook shaped arms extending from the base and generated by a gap there between, when each hooked shape arm is adapted to receive and hold a respective attachment beam of the blade.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figures 1, 2:
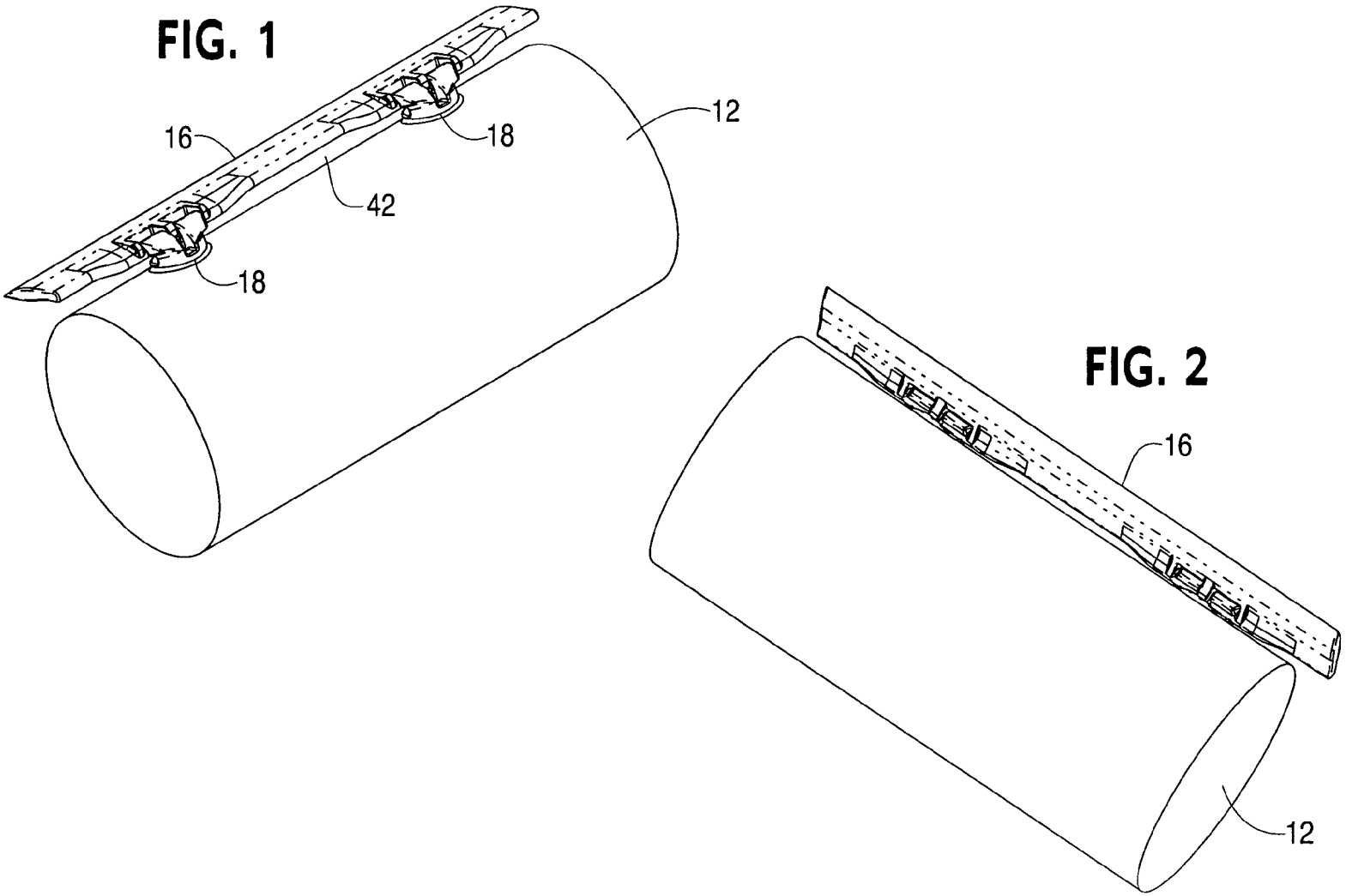
FIG. 1 is a perspective view of a portion of a scraped surface heat exchanger drive shaft using pins for attachment of a blade.
FIG. 2 is a perspective view of the items of FIG. 1 taken from a different angle.
Figure 3:
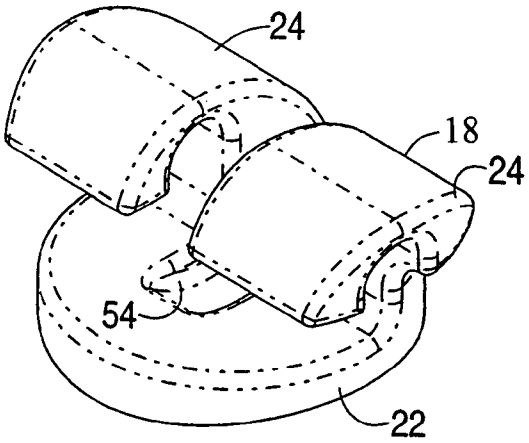
FIG. 3 is a perspective view of a mounting pin according to a preferred embodiment of the invention.

Preferred embodiments of the invention provide pivotal attachment of a blade to a drive shaft of a device such as a scraped surface heat exchanger. The invention will now be described with reference to the drawing figures, in which like reference numerals refer to like elements throughout.

Figure 10:
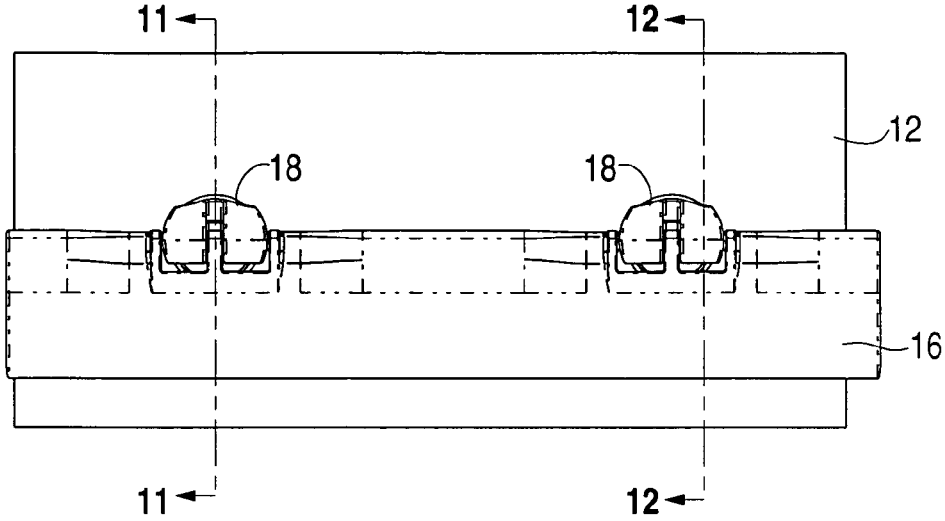
FIG. 10 is a top view of a blade, pins and a portion of a drive shaft in a fully installed and operating orientation.
Figure 11:
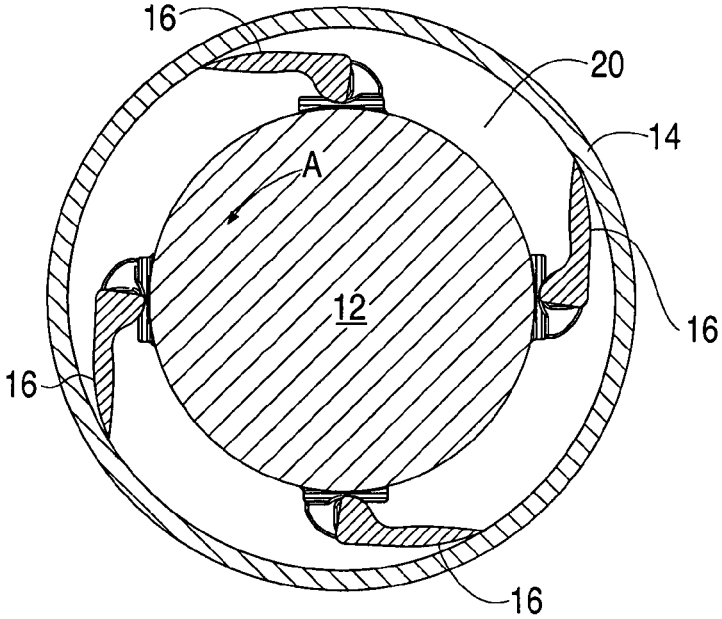
FIG. 11 is a cross sectional view taken through line 11—11 in FIG. 10, further showing an outer housing tube.

Turning to FIGS. 1, 2 and 11 initially, some components of a scraped surface heat exchanger are illustrated including a central drive shaft 12 which is powered for rotating motion, a stationary cylindrical outer housing tube 14 (seen in FIG. 11) which is surrounds either concentrically or eccentrically the drive shaft 12, and a blade 16 which is mounted to the shaft by two mounting pins 18. FIGS. 1 and 2 as well as FIGS. 7 and 10 of this description for convenience and simplicity illustrate a single blade 16 mounted to a portion of a shaft 12 of the scraped surface heat exchanger. However, there are preferably several blades 16 at even circumferential angles around the shaft 12 as illustrated for example by the four blades 16 in FIG. 11.

A space 20 is provided between the drive shaft 12 and the inner surface of housing tube 14 through which material passes longitudinally along the length of the scraped surface heat exchanger and travels along the longitudinal axis of the shaft 12 and the housing 14. As the material moves through the space 20, it is scraped and/or mixed by the blade 16 due to rotation of the shaft 12.

The operative direction of rotation of the shaft 12 in FIG. 1 is shown by the arrow A. It will be appreciated that as the material resists the motion being imparted by the blade 16, the material tends to urge the blades 16 outward and into sufficiently firm scraping contact with the inner surface of the housing tube 14. The housing tube 14 will usually be heated or cooled as known in the art of scraped heat exchangers, for example by having a fluid cooling or heating jacket or other type of heating or cooling element associated therewith.

FIG. 3–6 illustrate preferred pin 18 in more detail. The preferred pin 18 features a base 22 which has a curved bottom as shown for attachment to the outer surface of the central drive shaft 12. The pin 18 is typically welded to the drive shaft 12 but maybe attached by other affixing types. The pin 18 also features two relatively wide generally hook-shaped fingers 24 which can preferably together extend a width greater than the width of the base 22. The fingers 24 have an interior edge shape that forms a receptacle 26 that interacts with various features of the blade 16 as described in more detail below. Specifically, the receptacle 26 has a lower edge 28, a side edge 30 and a generally semi-circular concave portion 32 which is defined by the interior or underside surface of the hook portion 34 of the pin 18.

Figure 7:
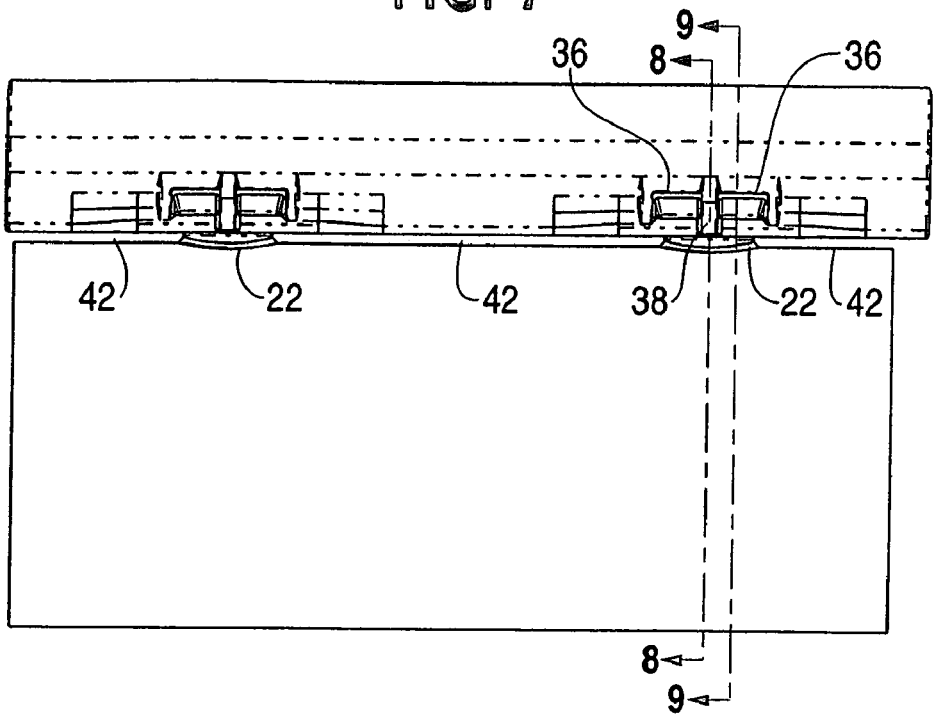
FIG. 7 is a side view of a portion of a drive shaft and scraped surface heat exchanger, showing mounting pins and a blade during the installation process.
Figure 8:
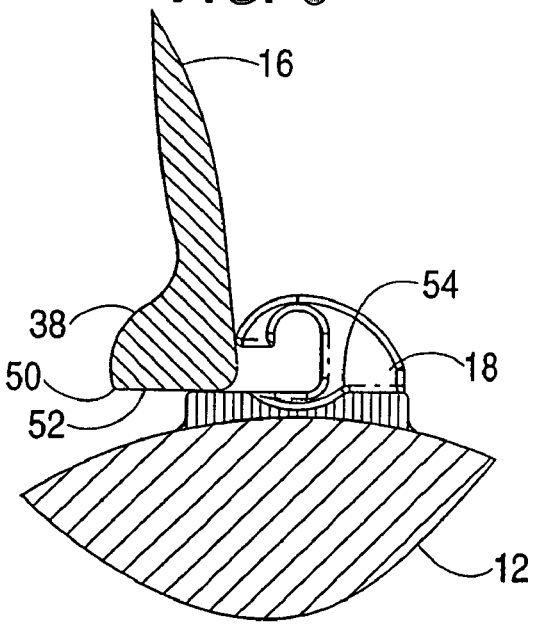
FIG. 8 is a cross sectional view taken through line 8—8 in FIG. 7.
Figure 9:
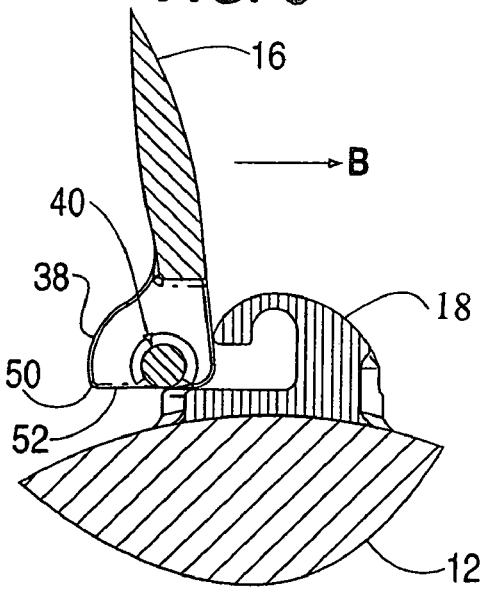
FIG. 9 is a cross sectional view taken through line 9—9 in FIG. 7.

Turning to FIGS. 7–12, the interaction of a blade 16 with the pins 18 is illustrated. As seen in FIGS. 7, 8, and 9, the blade 16 has a pair of cut-out areas 36 at a location corresponding to each pin 18. The cut-out areas 36 are located on either side of a central locking member 38. A respective attachment beam 40 extends outward from each side of the central supporting and locking member 38 to the other side of the cut-out 36. Thus, each pin 18 is associated with a pair of attachment beams 40, also referred to as dual attachment beams 40, each associated with a respective cut-out 36. In between the two cut-outs 36 is a central locking member 38 which serves to provide support to the attachment beams 40, and which also interacts with the pin 18 to lock the blade in place during operation, and to retain the attachment beams 40 in the concave area 32 of each pin 18 as described in more detail below. The locking member 38 can also be referenced to as a locking disc 38. Also, the word cut-out does not imply manufacturing by cutting or any particular method but refers to the shape of the feature.

Looking particularly at FIGS. 7 and 10, it will be appreciated that in the illustrated embodiment a single pin having a base of a certain size is able to provide an effective support area for the blade which may be considered to be wider than the base of the pin 18 itself. Moreover, the provision of the central locking member 38 serves not only a locking function but also gives support to the attachment beams 40 to prevent flexing of the blade 16 as a whole, as well as flexing of the beams 40 within the concave region 32 of the pin 18 itself. Thus, the preferred embodiment in some instances facilitates the use of fewer pins 18 for a given length of blade 16 than was required in the prior art.

The use of fewer pins 18 for a given length of blade 16 provides significant advantages in some circumstances. For example, the cost of fixing each pin 18 to the central shaft 12 is reduced. Moreover, a larger free area 42 (the area under the blade not interfered with by the base 22 of each pin 16) is further provided than would be available if more pins 18 were needed. Providing this larger free area 42 facilitates flow of the material under the blade which can enhance mixing flow properties and also reduce the force needed to drive the central shaft drive.

Another benefit of providing dual attachment beams 40, as opposed to a single attachment beam having the same effective length as the two attachment beams, is that with the dual beams 40, each beam 40 is relatively shorter and less susceptible to bending and buckling failure. Further, the central locking element 38 provides further stiffening due to its thickness.

Figure 6:
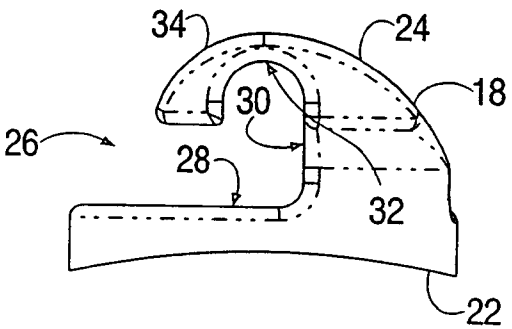
FIG. 6 is a side view of the pin of FIG. 3.
Figure 4:
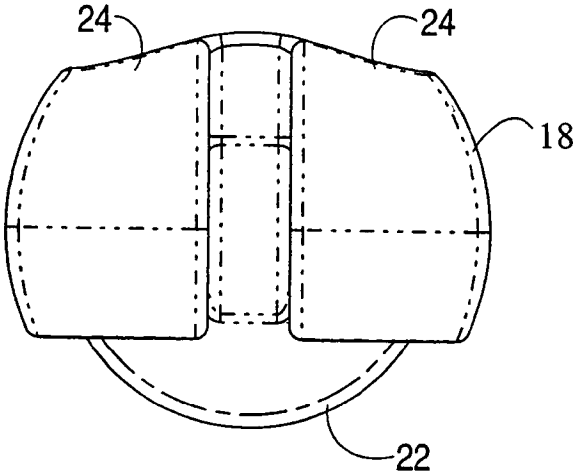
FIG. 4 is a top view of the pin of FIG. 3.
Figure 5:
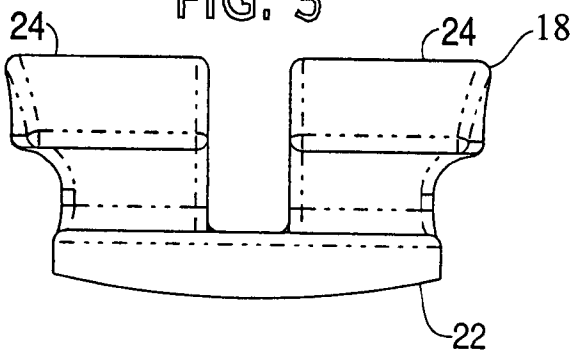
FIG. 5 is a front view of the pin of FIG. 3.

The method of installation of a blade 16 to a pin 18 will now be described in more detail with particular respect to FIGS. 6, 9 and 8. FIG. 9 illustrates the blade 16 in a configuration just at the beginning of the assembly process. The blade 16 is extending generally completely radially outward from the central drive shaft 12. In order to accomplish this arrangement, the drive shaft 12 has been removed from the outer housing 14, since when the drive shaft 12 is within the outer housing 14, the blade 16 cannot be positioned at this angle. The blade 16 has a pair of locking beams 40 extending from either side of the central locking feature 38. The central locking feature 38 has a lower cam corner 50 and a flat foot 52 as shown.

Figure 12:
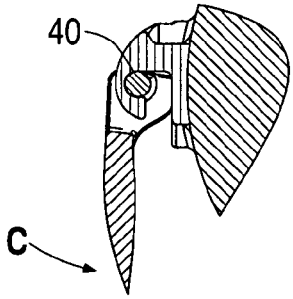
FIG. 12 is a cross sectional view taken through line 12—12 in FIG. 10 showing the blade in the configuration also shown in FIG. 11.

Initially, as in FIG. 9, the blade 16 is held in the generally vertical orientation and is slid in the direction shown by the arrow B. The foot 52 is generally flat and slides in the generally flat relationship along the surface 28 (FIG. 6) of the pin 18. Once it has been fully inserted so that the attachment beam 40 is resting in the corner between the surfaces 28 and 30 of the pin 18, the blade 16 is rotated in the direction shown by arrow C in FIG. 12 until it reaches substantially of the orientation shown in FIG. 12. As can be seen in FIG. 12, the attachment beam 40 is now urged into a pivoting but otherwise retrained relationship so that the surface of the attachment beam 40 is resting in the concave portion 32 (FIG. 6) of the pin 16.

The interaction of the foot 38 and the cam corner 50 with the surface 28 of the pin 18 serves to translate the attachment beam 40 upward from its position in FIG. 9 to its eventual position as shown in FIG. 12. Moreover, the interaction of the foot 38, and cam corner 50, serves to hold the pin 40 in this position so long as the blade 16 is angled substantially as shown in FIG. 12. In some embodiments it may be preferable to provide a small saddle 54 in the portion of the pin 18 between the arms 24 (see FIGS. 3 and 8). This saddle 54 receives the cam corner 50 and foot 38 to facilitate angular motion during installation and to permit a degree of angular motion during the operative position as shown in FIG. 12.

The position shown in FIG. 12 permits the shaft 12 and associated blades 16 to be installed within the outer housing 14 as generally shown by FIG. 11. When in the installed state shown in FIG. 11, the blade 16 is prevented from rotating in a direction opposite to the direction shown by arrow C in FIG. 12. A benefit of the locking arrangement using the central locking feature 38 having a cam corner 50, and foot 52, is that the blades 16 can be easily installed, but once they are pivoted in the direction shown by arrow C in FIG. 12 to a sufficient extent, they are restrained until they are rotated oppositely by a significant amount. This can facilitate the assembly of blades 16 onto a shaft 12 during the assembly process, because the shaft 12 and associated pins 18 can be at relatively wide range of angles, without the blades 16 being able to fall off their respective pins 18.

The blades, pins and shafts may of any suitable materials as desired. In some preferred heat exchangers, the drive shaft 12 is stainless steel and the pins 18 are stainless steel items welded on to the shaft. The blade 16 is preferably made from a nonmetallic material in order to facilitate forming of desired blade shapes, and preferred blade materials include molded plastics such as Victrex PEEK (polyaryletheretherketone) or Ticona Celcon (acetyl copolymer). Alternatively, the blade can be for example a processed metal such as stainless steel. A benefit of some embodiments of the present invention, is that the elongated dual attachment beams 40 can be provided, and due to the provision of the central supporting element 38 it can have a desirably long effective supporting length without being subjected to such stress that a metal strengthening insert would necessarily be required. However, the locking feature of some embodiments of some invention does not require that there be dual attachment beams with the locking feature provided on a central element. For example, alternative embodiments can include a single attachment beam extending across a single cutout. A locking feature including a foot 52, and a cam corner 50 may be provided at any location along the blade, most preferably in such an embodiment adjacent to one side of the cutout to interact with a corresponding feature on the pin. In such an embodiment, a single finger would preferably be used with a single beam, and of the saddle 56 if provided would be located to the side of the respective finger, rather than centrally between two fingers as shown in the embodiment of FIGS. 1–11.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A pin for attaching a blade to a drive shaft of a scraped surface heat exchanger, the pin comprising:

a base portion; and two generally hook-shaped arm portions extending from the base portion and separated by a gap therebetween, wherein the pin attaches the blade to the drive shaft of the scraped surface heat exchanger.

2. A pin according to claim 1, wherein each arm portion has a first flat surface, a second flat surface generally perpendicular to the first flat surface, and a generally semi-circular concave surface extending from the second flat surface in opposed facing relationship to the first flat portion.

3. A pin according to claim 2, further comprising a saddle indentation disposed on the first flat portion between the two arms.

4. A pin according to claim 1, wherein the two arms and the gap together form a width greater than a width of the base.

5. A blade for use with a scraped surface heat exchanger having a drive shaft, the scraped surface heat exchanger blade comprising:

at least one attachment region including a pair of cutouts each having a respective attachment beam extending across the respective cutout portion.

6. A blade according to claim 5, wherein the attachment beams are adopted to be received by respective arms of an attachment pin mounted to the drive shaft.

7. A blade attaching system for use with a scraped surface heat exchanger having a drive shaft, comprising:

a scraped surface heat exchanger blade having at least one attachment region including a pair of cutouts each having a respective attachment beam extending across the respective cutout portion; and a pin having a base and two generally hook shaped arms extending from the base and generated by a gap there between, wherein each hooked shape arm is adapted to receive and hold a respective attachment beam of the scraped surface heat exchanger blade.

8. A system according to claim 7, wherein the scraped surface heat exchanger blade comprises two attachment regions each having two cutouts, and wherein the system comprises two pins mounted to the drive shaft.

9. A pin for attaching a blade to a drive shaft of a scraped surface heat exchanger, the pin comprising:

means for mounting the pin to the drive shaft of the scraped surface heat exchanger; and means for retaining the scraped surface heat exchanger blade, comprising two generally hook-shaped arm portions extending from the mounting means and separated by a gap therebetween.

10. A pin according to claim 9, wherein each arm portion has a first flat surface, a second flat surface generally perpendicular to the first flat surface, and a generally semi-circular concave surface extending from the second flat surface in opposed facing relationship to the first flat surface.

11. A pin according to claim 10, wherein each concave surface is adapted to receive an attachment beam of the scraped surface heat exchanger blade.

12. A pin according to claim 10, further comprising a saddle indentation disposed on the first flat portion between the two arms.

13. A pin according to claim 10, wherein the two arms and the gap together form a width greater than a width of the base.

14. A blade for use with a scraped surface heat exchanger having a drive shaft with at least one pin, the scraped surface heat exchanger blade comprising:

a body portion; and at least one means for attaching the scraped surface heat exchanger blade to the pin, including a pair of cutouts each having a respective attachment beam extending across the respective cutout portion.

15. A blade according to claim 14, wherein the scraped surface heat exchanger blade comprises two attaching means each having the pair of cutouts.

16. A blade attaching system for use with a scraped surface heat exchanger having a drive shaft, comprising:

blade retaining means mounted to the drive shaft having a base and two generally hook shaped arms extending from the base and generated by a gap there between, wherein each hooked shape arm is adapted to receive and hold a respective attachment beam of a scraped surface heat exchanger blade; and means for attaching the scraped surface heat exchanger blade to the blade retaining means including a pair of cutouts each having a respective attachment beam extending across the respective cutout portion.

17. A blade attaching method for use with a scraped surface heat exchanger having a drive shaft, comprising:

providing a scraped surface heat exchanger blade having at least one attachment region including a pair of cutouts each having a respective attachment beam extending across the respective cutout portion; and inserting the scraped surface heat exchanger blade into a pin having a base and two generally hook shaped arms extending from the base and generated by a gap there between, wherein each hooked shaped arm is adapted to receive and hold the respective attachment beam of the scraped surface heat exchanger blade.

18. A method according to claim 17, wherein the scraped surface heat exchanger blade has two attachment regions and two corresponding pins are provided on the drive shaft.

* * * * *